US009719510B2

(12) United States Patent
Fujioka et al.

(10) Patent No.: US 9,719,510 B2
(45) Date of Patent: Aug. 1, 2017

(54) SCROLL FLUID MACHINE INCLUDING PINS AND GUIDE RINGS

(71) Applicant: ANEST IWATA Corporation, Yokohama-shi, Kanagawa (JP)

(72) Inventors: Tamotsu Fujioka, Yokohama (JP); Atsushi Unami, Yokohama (JP); Hiroshi Ito, Yokohama (JP); Takaaki Izumi, Yokohama (JP)

(73) Assignee: ANEST IWATA Corporation, Yokohama-shi, Kanagawa (JP)

( * ) Notice: Subject to any disclaimer, the term of this patent is extended or adjusted under 35 U.S.C. 154(b) by 5 days.

(21) Appl. No.: 14/927,597

(22) Filed: Oct. 30, 2015

(65) Prior Publication Data

US 2016/0131133 A1 May 12, 2016

(30) Foreign Application Priority Data

Nov. 7, 2014 (JP) ..... 2014-227360

(51) Int. Cl.
*F03C 2/00* (2006.01)
*F03C 4/00* (2006.01)
(Continued)

(52) U.S. Cl.
CPC ..... *F04C 18/0253* (2013.01); *F01C 1/0223* (2013.01); *F01C 1/0253* (2013.01); *F01C 17/063* (2013.01); *F01C 21/003* (2013.01); *F04C 18/0223* (2013.01); *F01C 21/02* (2013.01); *F04C 23/001* (2013.01); *F04C 23/008* (2013.01)

(58) Field of Classification Search
CPC ..... F04C 18/0215; F04C 18/0253; F04C 18/0223; F04C 23/001; F04C 23/008; F01C 1/0253; F01C 1/0223; F01C 17/063; F01C 21/003133; F01C 21/003
USPC ..... 418/55.1–55.6, 57, 60, 150; 464/102, 464/104
See application file for complete search history.

(56) References Cited

U.S. PATENT DOCUMENTS 4,990,071 A * 2/1991 Sugimoto ..... F01C 17/066 418/55.3
5,242,282 A * 9/1993 Mitsunaga ..... F01C 17/066 418/55.3

(Continued)

FOREIGN PATENT DOCUMENTS

JP 05248369 A * 9/1993 ..... F01C 17/066
JP H9-250463 9/1997
JP 2011-252434 A 12/2011

*Primary Examiner* — Theresa Trieu
(74) *Attorney, Agent, or Firm* — Drinker Biddle & Reath LLP

(57) ABSTRACT

A scroll expander includes: a driving scroll body having a first axis line as a rotary shaft line; a driven scroll body having, as a rotary shaft, a second axis line shifted with respect to the first axis line; a bearing plate having the second axis line as a rotary shaft; a cylindrical driving pin attached to the driving scroll body; and a cylindrical guide ring attached to the bearing plate and having an inner diameter larger than an outer diameter of the driving pin. Four driving pins are disposed on the circumference of a circle around the first axis line at an equal interval. Four guide rings are disposed on the circumference of a circle around the second axis line at the equal interval so as to correspond to the four driving pins.

2 Claims, 8 Drawing Sheets

(51) Int. Cl.

| | |
|---|---|
| ***F04C 2/00*** | (2006.01) |
| ***F04C 18/02*** | (2006.01) |
| ***F01C 1/02*** | (2006.01) |
| ***F01C 17/06*** | (2006.01) |
| ***F01C 21/00*** | (2006.01) |
| *F04C 23/00* | (2006.01) |
| *F01C 21/02* | (2006.01) |

(56) References Cited

U.S. PATENT DOCUMENTS

| | | | | |
|---|---|---|---|---|
| 6,758,659 | B2 * | 7/2004 | Ni | F01C 17/066 418/55.3 |
| 7,467,933 | B2 * | 12/2008 | Ni | F01C 17/066 418/55.3 |
| 2013/0309116 | A1 | 11/2013 | Unami et al. | |
| 2013/0315767 | A1 | 11/2013 | Unami et al. | |

* cited by examiner

SCROLL FLUID MACHINE INCLUDING PINS AND GUIDE RINGS

TECHNICAL FIELD

The present invention relates to a scroll fluid machine.

BACKGROUND

Scroll fluid machine compresses or expands a working medium by relative movement between scroll bodies including helical wraps. A scroll expander is a type of the scroll fluid machine. The scroll expander includes an expansion chamber formed of a pair of scroll bodies. The scroll expander converts energy upon expansion of a high-pressure working medium in the expansion chamber into rotational energy. As technology in such a field, a scroll expander described in JP 2011-252434 A has been known.

SUMMARY

Scroll bodies of a scroll fluid machine rotate around respective rotary shafts. One of the scroll bodies relatively orbits with respect to the other scroll body. For example, a scroll fluid machine described in JP 2011-252434 A includes a rotation regulating mechanism for relative orbiting movement. A mechanism that tolerates the orbiting movement has a more complicated structure than that of a mechanism that tolerates rotary movement (for example, bearing). Moreover, the mechanism that tolerates the orbiting movement tends to increase the number of mechanical contact parts. Therefore, since force and a moment easily vary upon the orbiting movement, it is difficult for the scroll fluid machine to maintain a favorable rotating state.

The present invention has been made in consideration of the above-described problem. An object of the present invention is to provide a scroll fluid machine that can maintain a favorable rotating state.

A scroll fluid machine according to one embodiment of the present invention includes: a driving scroll body that includes a pair of driving end plates and a driving wrap formed on each of the pair of driving end plates, and has a first axis line as a rotary shaft line; a driven scroll body that includes a driven end plate and a driven wrap formed on each of both surfaces of the driven end plate, is disposed between the pair of driving end plates, and has, as a rotary shaft line, a second axis line shifted with respect to the first axis line; a bearing plate disposed on each of both sides of the driven scroll body, includes a pair of plates coupled to the driven scroll body, and has the second axis line as a rotary shaft line; a cylindrical driving pin that is attached to the driving scroll body, and protrudes from the driving end plate to the bearing plate; and a cylindrical guide ring that is attached to the bearing plate and includes an inner diameter larger than an outer diameter of the driving pin. n driving pins ($n \geq 4$) or more are disposed on a circumference of a circle around the first axis line at an equal interval, and m guide rings ($m=n \geq 4$) or more are disposed on a circumference of a circle around the second axis line at the equal interval so as to correspond to the driving pins.

In the above-described scroll fluid machine, the driving pin revolves around the first axis line. One end of this driving pin is disposed in the guide ring. Therefore, the driving pin revolves around the first axis line while pressing an inner circumferential surface of the guide ring. A direction of force caused by this revolution (hereinafter, also referred to as a pin input) constantly corresponds to a tangent direction of a circle around the first axis line. A vertical component of the pin input (hereinafter, also referred to as action force to the guide ring) acts from the driving pin to the guide ring. Meanwhile, a direction of the pin input varies depending on a revolution position of the driving pin. For example, when the vertical component of the pin input is in a vertically downward direction, force acts on the guide ring. In contrast, the vertical component of the pin input is in a vertically upward direction, no force acts on the guide ring. Here, four or more sets of the driving pin and the guide ring are disposed at an equal interval. Thus, there are two sets of the guide ring and the driving pin that generates the force in the vertically downward direction so as to press the guide ring. Therefore, upon orbiting movement of the scroll body, at least two sets of the driving pin and the guide ring support the driving scroll body. According to this configuration, since bearing power of the driving scroll body is smoothly received, a variation of the bearing power upon the orbiting movement is inhibited. Therefore, the scroll fluid machine according to the one embodiment of the present invention can maintain a favorable rotating state.

In one embodiment, the number of the driving pins (n) and the number of the guide rings (m) may be an even number. A description in which the center of the pair of driving end plates is defined as a standard of rotary movement, will be given. A moment acts from the driving scroll body to the driven scroll body other than the above-described action force to the guide ring. This moment is based on a distance between the first axis line and a position where the action force to the guide ring is input (hereinafter, also referred to as an action distance) and magnitude of the action force to the guide ring. The driving pin is disposed on a circumference of a circle around the first axis line. Meanwhile, the guide ring that is pressed by the driving pin is disposed on a circumference of a circle around the second axis line. The moment periodically varies with the arrangement of the driving pin. Here, the number of the driving pins and the number of the guide rings are an even number. The number of sets of the guide ring and the driving pin that generates the action force to the guide ring in the vertically downward direction, is constant regardless of a revolution angle. Accordingly, the periodical variation of the moment is inhibited and then the periodical variation of the moment generated upon the orbiting movement is inhibited. Therefore, the scroll fluid machine according to the one embodiment of the present invention can maintain a more favorable rotating state.

In one embodiment, the number of the driving pins (n) and the number of the guide rings (m) may be six ($n=m=6$). Since the number of the driving pins and the number of the guide rings are the even number, the periodical variation of the moment generated upon the orbiting movement is inhibited. Moreover, when the number of the driving pins and the number of the guide rings are six, the driving scroll body is constantly supported by two sets or more of the driving pin and the guide ring in the orbiting movement of the driven scroll body with respect to the driving scroll body. Therefore, the scroll fluid machine according to the one embodiment of the present invention can preferably inhibit the periodical variation of the moment and the variation of the action force to the guide ring that are generated upon the orbiting movement. As a result, a more favorable rotating state can be maintained.

A scroll fluid machine according to one embodiment of the present invention can maintain a favorable rotating state.

DETAILED DESCRIPTION

An embodiment of the present invention will be described below with reference to the attached drawings. In descriptions of the drawings, substantially the same elements are denoted with the same reference signs, and redundant description thereof will be omitted.

Figure 1:
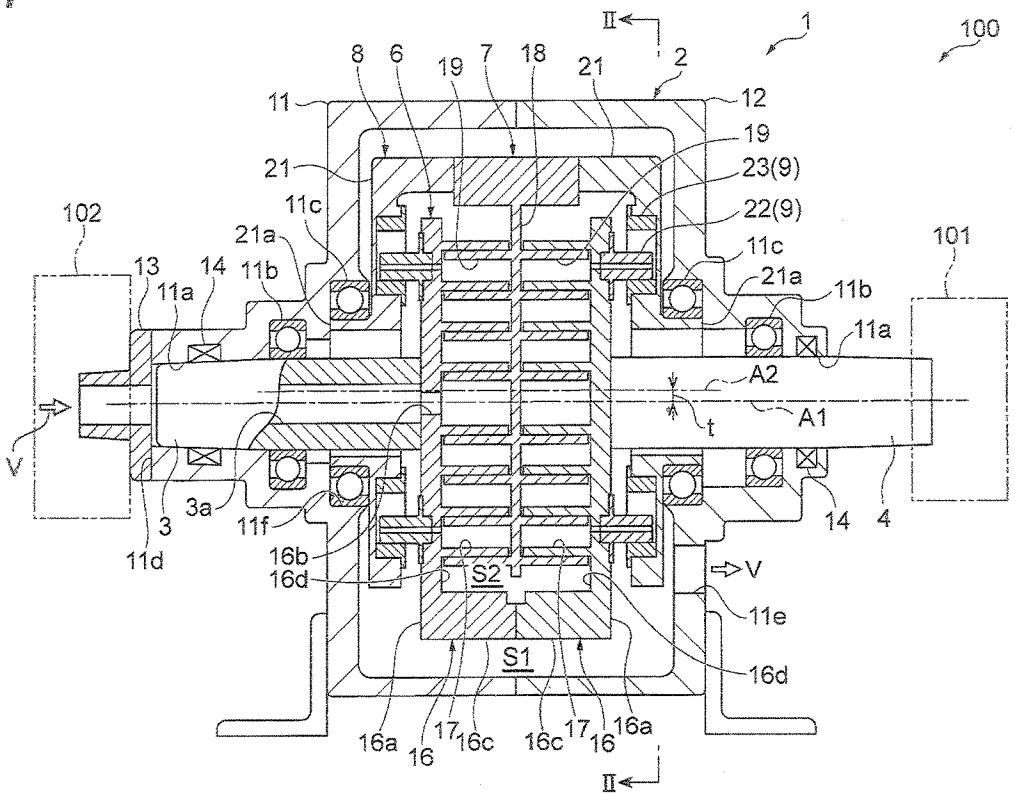
FIG. 1 is a sectional view of a scroll expander according to one embodiment of the present invention.

As illustrated in FIG. 1, a power generation system 100 including a scroll expander 1 drives a dynamo 101 by using the scroll expander 1 as a power source. A working medium supplying portion 102 supplies steam V as a working medium to the scroll expander 1. Examples of the steam V include water vapor, and a refrigerant that is used for a rankine cycle. The scroll expander 1 converts energy occurring upon expansion of the supplied steam V inside the scroll expander 1 into rotational energy. The scroll expander 1 transmits the rotational energy to the dynamo 101 through a driving shaft. The steam V after the expansion is discharged to the outside of the scroll expander 1. A temperature of the steam V to be discharged is lower than that of the steam V to be supplied. The scroll expander 1 extracts, as the rotational energy, energy corresponding to a difference between the temperature of the steam V upon the supply and the temperature of the steam V upon the discharge.

The scroll expander 1 includes, as main constituent components, a housing 2, an input driving shaft 3, an output driving shaft 4, a driving scroll body 6, a driven scroll body 7, a bearing plate 8, and an interlocking mechanism 9.

The housing 2 includes a pair of cases 11 and 12. The housing 2 forms a housing space S1. The housing space S1 houses the driving scroll body 6, the driven scroll body 7, the bearing plate 8, and the interlocking mechanism 9. The case 11 includes a shaft hole 11*a*. The input driving shaft 3 is inserted into the shaft hole 11*a*. A central axis line of the shaft hole 11*a* defines a first axis line A1. A driving bearing 11*b* and a driven bearing 11*c* are disposed in the case 11. The driving bearing 11*b* rotatably supports the input driving shaft 3. The driven bearing 11*c* rotatably supports the bearing plate 8. A central axis line of the driving bearing 11*b* corresponds to the first axis line A1. Meanwhile, a central axis line of the driven bearing 11*c* corresponds to a second axis line A2. The second axis line A2 is shifted by a distance t with respect to the first axis line A1. The second axis line A2 is defined by a central axis line of a bearing holding portion 11*f*. The driven bearing 11*c* is fitted into the bearing holding portion 11*f*. A cap 13 is attached to an opening end 11*d* of the case 11. The cap 13 serves as an interface with the working medium supplying portion 102. In a direction of the first axis line A1, an oil seal 14 is disposed between the driving bearing 11*b* and the opening end 11*d*. The case 12 includes substantially the same structure as the case 11. That is, the case 12 includes the shaft hole 11*a*. The driving bearing 11*b* and the driven bearing 11*c* are disposed in the case 12. Moreover, the case 12 includes an outlet 11*e*. The outlet lie discharges the steam V after the expansion.

The input driving shaft 3 is inserted into the shaft hole 11*a* of the case 11. Therefore, a rotary shaft line of the input driving shaft 3 corresponds to the first axis line A1. One end of the input driving shaft 3 is attached to the driving scroll body 6. The input driving shaft 3 includes a working medium introducing hole 3*a*. The steam V is introduced through the working medium introducing hole 3*a*. The working medium introducing hole 3*a* penetrates from the one end to the other end of the input driving shaft 3. The output driving shaft 4 is inserted into the shaft hole 11*a* of the case 12. Therefore, a rotary shaft line of the output driving shaft 4 corresponds to the first axis line A1. One end of the output driving shaft 4 is attached to the driving scroll body 6. Moreover, the other end of the output driving shaft 4 is coupled to the dynamo 101.

The housing space S1 houses the driving scroll body 6. The driving scroll body 6 is rotatable around the first axis line A1. The driving scroll body 6 includes a pair of driving end plates 16 and a pair of driving wraps 17. Each of the pair of driving end plates 16 includes a disk-like shape. An outer circumferential edge portion 16*c* of one of the driving end plates 16 is coupled to the outer circumferential edge portion 16*c* of the other driving end plate 16. The input driving shaft 3 is attached to an outer surface 16*a* of the one driving end plate 16. Moreover, the one driving end plate 16 includes a working medium introducing hole 16*b*. The steam V is introduced through the working medium introducing hole 16*b*. The working medium introducing hole 16*b* communicates with the working medium introducing hole 3*a* of the input driving shaft 3. The output driving shaft 4 is attached to the outer surface 16*a* of the other driving end plate 16. The driving wrap 17 is formed on an inner surface 16*d* of the driving end plate 16. The driving wrap 17 includes a helical shape or a spiral shape. That is, the driving wraps 17 are disposed between the pair of driving end plates 16. The above-described input driving shaft 3 and the above-described output driving shaft 4 are integrally formed through the driving scroll body 6. The input driving shaft 3, the output driving shaft 4, and the driving scroll body 6 integrally rotate around the first axis line A1.

The housing space S1 houses the driven scroll body 7. The driven scroll body 7 is rotatable around the second axis line A2. The driven scroll body 7 includes a driven end plate 18 and a driven wrap 19. The driven end plate 18 includes a disk-like shape. The driven end plate 18 is disposed between the driving end plates 16 of the driving scroll body 6. The driven end plate 18 is coupled to the bearing plate 8. The driven wrap 19 is formed on each surface of the driven end plate 18 in a direction toward the driving end plates 16. The driven wrap 19 includes a helical shape or a spiral shape. The driving end plates 16, the driven end plate 18, the driving wraps 17, and the driven wraps 19 form an expansion chamber S2. The expansion chamber S2 for expanding the steam V includes a helical shape or a spiral shape.

The bearing plate 8 rotatably supports the driven scroll body 7 around the second axis line A2. The bearing plate 8 includes a pair of plates 21. The plates 21 each include substantially a disk-like shape. In a direction of the first axis line A1 (or the second axis line A2), one of the pair of plates 21 is disposed between the one driving end plate 16 and the case 11. The other plate 21 is disposed between the other driving end plate 16 and the case 12. That is, the bearing plate 8 is disposed so as to interpose the driving scroll body 6 and the driven scroll body 7. An outer circumferential edge portion of the plate 21 is coupled to an outer circumferential edge portion of the driven end plate 18. The plate 21 includes a rotary shaft portion 21*a*. A rotary central shaft of the rotary shaft portion 21*a* is the second axis line A2. The rotary shaft portion 21*a* is formed on the side of a surface of the plate 21, the surface facing the case 11. The rotary shaft portion 21*a* fits into the driven bearing 11*c*. Therefore, the bearing plate 8 and the driven scroll body 7 rotate around the second axis line A2. This driven scroll body 7 is coupled to the bearing plate 8.

Figure 2:
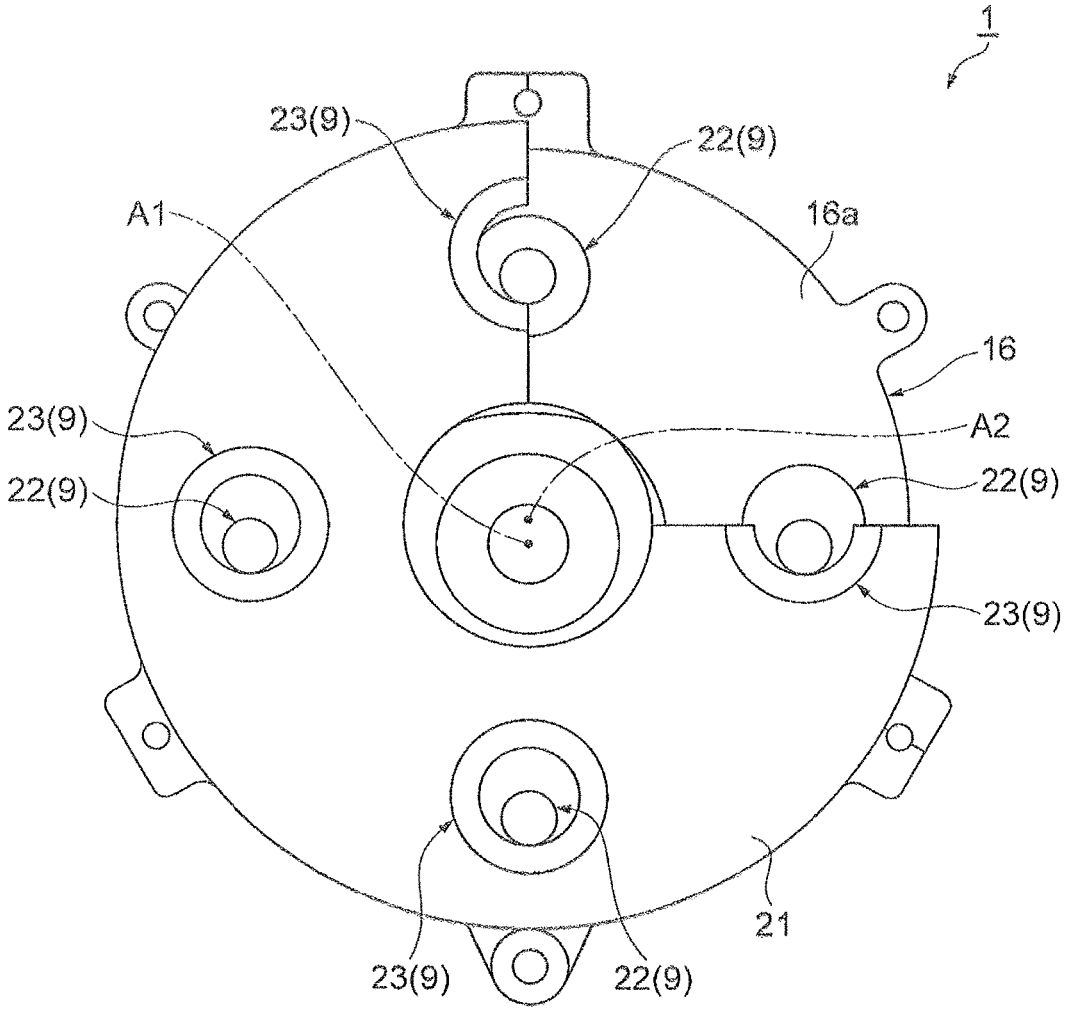
FIG. 2 is a front view of arrangement of a driving pin and a guide ring in a section taken along line II-II of FIG. 1.

The interlocking mechanism 9 interlocks the driving scroll body 6 and the driven scroll body 7. Specifically, the interlocking mechanism 9 mutually synchronously rotates the driving scroll body 6 and the driven scroll body 7. The interlocking mechanism 9 includes a driving pin 22 and a guide ring 23. The driving pin 22 is attached to the driving scroll body 6. The guide ring 23 is attached to the bearing plate 8. Therefore, the number of driving pins 22 in the scroll expander 1 is four (n=4). Moreover, the number of the guide rings 23 is also four (m=4). As illustrated in FIG. 2, the scroll expander 1 includes four interlocking mechanisms 9. The four interlocking mechanisms 9 are disposed at an interval of 90° along a direction of the circumference of a circle around the first axis line A1. Each of the four interlocking mechanisms 9 is disposed on a virtual axis line parallel to the first axis line A1. Four interlocking mechanisms 9 are disposed on the side of the input driving shaft 3. Another four interlocking mechanisms 9 are disposed on the side of the output driving shaft 4.

Figure 3:
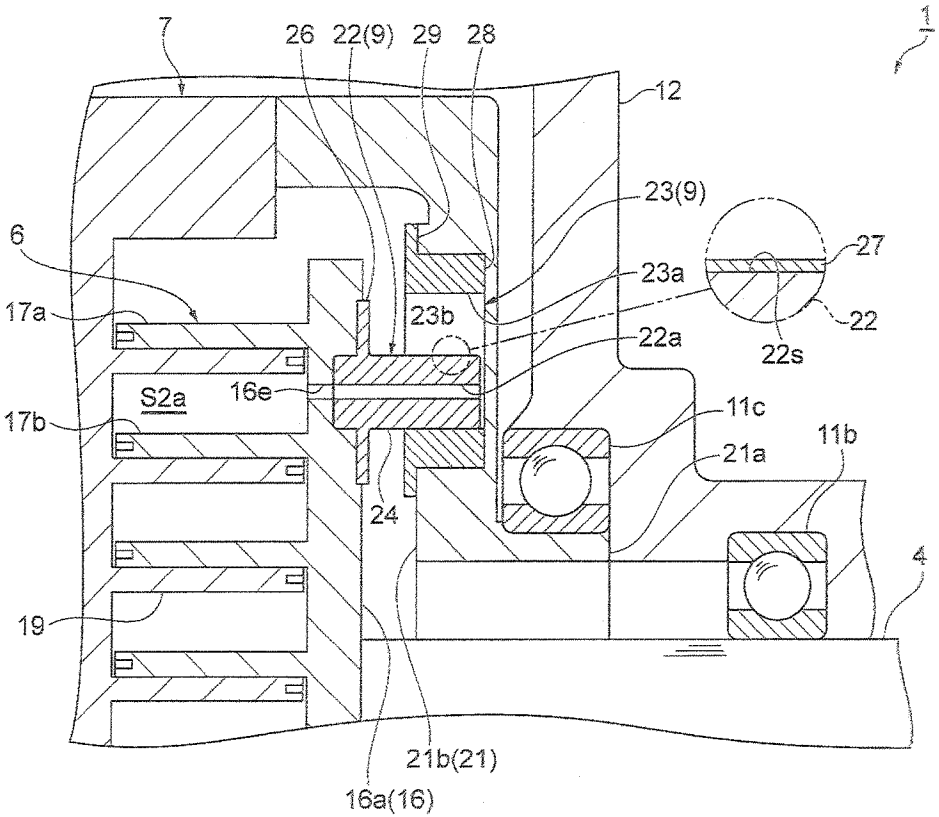
FIG. 3 is an enlarged sectional view illustrating the driving pin and the guide ring.

As illustrated in FIG. 3, one end side of the driving pin 22 is attached to the driving end plate 16 of the driving scroll body 6. The other end side of the driving pin 22 is disposed inside the guide ring 23. The driving pin 22 includes a pin portion 24 and a flange portion 26. The pin portion 24 includes a columnar shape that extends along the direction of the first axis line A1. The flange portion 26 is formed on the one end side of the driving pin 22. The pin portion 24 and the flange portion 26 are integrally formed. The driving pin 22 includes a metallic material (for example, SUS303 material). One end of the pin portion 24 is fitted into a recess portion of the driving end plate 16. The flange portion 26 is fixed to the outer surface 16*a* of the driving end plate 16 by, for example, a bolt. The other end side of the pin portion 24 is disposed inside the guide ring 23.

An outer circumferential surface 22*s* on the other end side of the pin portion 24 comes in contact with an inner circumferential surface 23*a* of the guide ring 23. The outer circumferential surface 22*s* includes a hard film 27. The hard film 27 is formed of an amorphous material that mainly includes a hydrocarbon or an isotope of carbon. Specifically, the hard film 27 is formed of diamond-like carbon (DLC). The hard film 27 has a thickness of 1 μm or more and 5 μm or less, for example. The hard film 27 including diamond-like carbon imparts lubricity and wear resistance to a contact portion of the driving pin 22 with the guide ring 23. The hard film 27 may include other components as an add-in material other than the hydrocarbon or the isotope of carbon as the main component. For example, a plasma CVD method or a PVD method is used for forming the hard film 27.

The driving pin 22 includes a condensate supplying hole 22*a* as a condensate supplying portion. The condensate supplying hole 22*a* leads the steam V or condensate to the inside of the guide ring 23. The condensate supplying hole 22*a* supplies the condensate to a gap between the guide ring 23 and the driving pin 22. When the steam V is water vapor, the condensate is water. The condensate supplying hole 22*a* is a through-hole that passes from one end surface to the other end surface of the pin portion 24. The one end side of the pin portion 24 is fitted into the driving end plate 16. The condensate supplying hole 22*a* communicates with a condensate supplying hole 16*e* of the driving end plate 16 on the one end side of the pin portion 24. The expansion chamber S2 is connected to the inside of the guide ring 23 through the condensate supplying hole 16*e* and the condensate supplying hole 22*a*. Therefore, the steam V or the condensate in the expansion chamber S2 is introduced into the inside of the guide ring 23. Note that the steam V after the expansion is preferably introduced into the guide ring 23. Therefore, the condensate supplying hole 16*e* of the driving end plate 16 may be provided at a position that communicates with a space S2*a* formed of the driving wrap 17. The space S2*a* is a space between an outermost circumferential driving wrap portion 17*a* of the driving scroll body 6 and a driving wrap portion 17*b* adjacent to the driving wrap portion 17*a*. Moreover, the driving pin 22 including the condensate supplying hole 22*a* that communicates with the condensate supplying hole 16*e* may be attached to the same position as the condensate supplying hole 16*e* on the driving end plate 16. Specifically, the driving pin 22 is attached to the driving end plate 16 such that an axis line of the condensate supplying hole 16*e* is disposed between the driving wrap portions 17*a* and 17*b*.

The guide ring 23 is attached to an inner surface 21*b* of the plate 21. The inner surface 21*b* of the plate 21 faces the outer surface 16*a* of the driving scroll body 6. The guide ring 23 includes a polymer resin material with self-lubricity. An example of the polymer resin material includes a polyether ether ketone (PEEK) resin. Note that, the guide ring 23 may include a polyphenylene sulfide (PPS) resin. The guide ring 23 includes a cylindrical shape. The guide ring 23 includes a ring portion 28 and a flange portion 29. The flange portion 29 is formed on one end side of the ring portion 28. The ring portion 28 is fitted into a recess portion of the plate 21. The flange portion 29 is fixed to the plate 21 by a bolt. The ring portion 28 includes a guide hole 23*b*. The driving pin 22 is disposed in the guide hole 23*b*. The guide hole 23*b* is defined by the inner circumferential surface 23*a* of the guide ring 23. An inner diameter of the guide hole 23*b* is larger than an outer diameter of the pin portion 24 of the driving pin 22. A central axis line of the driving pin 22 is shifted with respect to a central axis line of the guide ring 23. An amount of this shift is substantially the same as that of the second axis line A2 with respect to the first axis line A1 (distance t, refer to FIG. 1). Therefore, the hard film 27 of the driving pin 22 comes in contact with the inner circumferential surface 23*a* of the ring portion 28.

As illustrated in FIG. 1, the working medium supplying portion 102 supplies the steam V to the scroll expander 1 including the above-described configuration through the cap 13. The steam V is introduced into the expansion chamber S2 through a through-hole of the cap 13 and the working medium introducing hole 3*a* of the input driving shaft 3. The steam V introduced into the expansion chamber S2 expands in a space formed of the driving wrap 17 and driven wrap 19. Then, the steam V moves from the center of the expansion chamber S2 to an outer circumference of the expansion chamber S2. The steam V discharged from the expansion chamber S2 to the inside of the housing 2 is discharged from the outlet 11*e*. Relative revolution movement of the driven scroll body 7 with respect to the driving scroll body 6 (orbiting movement) occurs due to this expansion. When viewed from the housing 2, this revolution movement is observed as rotary movement of the driving scroll body 6 around the first axis line A1 and rotary movement of the driven scroll body 7 around the second axis line A2. Therefore, the output driving shaft 4 attached to the driving scroll body 6 rotates around the first axis line A1. This rotary movement of the output driving shaft 4 is transmitted to the dynamo 101.

This scroll expander 1 regulates relative rotation movement of the driven scroll body 7 with respect to the driving scroll body 6 by the driving pin 22 and the guide ring 23, and tolerates the relative revolution movement. The scroll expander 1 based on this principle is simple and have few constituent elements. Therefore, reduction in a manufacturing cost is achieved. Then, the driving pin 22 and the guide ring 23 regulate the relative rotation movement of the driven scroll body 7 with respect to the driving scroll body 6. Then, in a state where the outer circumferential surface 22*s* of the driving pin 22 is in close contact with the inner circumferential surface 23*a* of the guide ring 23, a slide in a tangent direction of the inner circumferential surface 23*a* or the outer circumferential surface 22*s* occurs between the outer circumferential surface 22*s* of the driving pin 22 and the inner circumferential surface 23*a* of the guide ring 23. This slide tolerates the revolution movement of the driven scroll body 7 with respect to the driving scroll body 6. Therefore, the scroll expander 1 needs no bearing including a rolling element in order to define the relative movement between the driving scroll body 6 and the driven scroll body 7. Therefore, the scroll expander 1 can suppress an increase in the mechanical energy loss. Further, the hard film 27 including diamond-like carbon is formed on the outer circumferential surface 22*s* of the driving pin 22. The guide ring 23 includes the polyether ether ketone resin. A favorable sliding state is obtained due to contact between the hard film 27 and the polyether ether ketone resin. Therefore, the stable orbiting movement can be realized with low abrasion over a long period. Further, when the condensate is present in the gap between the driving pin 22 and the guide ring 23, since a coefficient of friction between the driving pin 22 and the guide ring 23 reduces, further reduction in the mechanical energy loss can be achieved. Therefore, the scroll expander 1 can maintain a favorable rotating state.

The driving pin 22 includes the condensate supplying hole 22*a*. The condensate formed by condensation of the steam V is supplied to the gap between the driving pin 22 and the guide ring 23 through the condensate supplying hole 22*a*. The steam V or the condensate is forcibly supplied by expansion pressure of the steam V in the expansion chamber S2 toward an opening on the side of a top of the driving pin 22 through the condensate supplying hole 22*a*. Therefore, the condensate is forcibly supplied to the gap between the driving pin 22 and the guide ring 23. Since a lubricating state between the driving pin 22 and the guide ring 23 becomes favorable due to this condensate, reduction in the mechanical energy loss associated with relative rotary movement of the driven scroll body 7 with respect to the driving scroll body 6 can be achieved. Then, stable supply of the condensate can reduce required power and operation noise. In short, the scroll expander 1 uses, as a lubricant, the condensate formed by the condensation of evaporated gas due to the expansion.

Figure 4A:
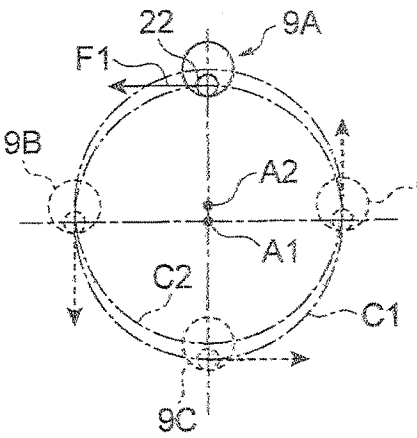
FIGS. 4A, 4B, 4C, 4D, 4E and 4F are schematic diagrams illustrating a pin input, action force to a guide ring, and a component in the scroll expander according to the one embodiment.

Next, operation of the scroll expander 1 according to the present embodiment will be described in detail. FIGS. 4A, 4B, 4C, 4D, 4E, and 4F are schematic diagrams illustrating interlocking mechanisms 9A, 9B, 9C, and 9D revolving around the first axis line A1. The interlocking mechanism 9A is carefully observed. As illustrated in FIG. 4A, a driving pin 22 of the interlocking mechanism 9A is driven in a tangent direction of a virtual circle C1 around the first axis line A1. Force caused by revolution of the driving pin 22 will be referred to as a pin input F1 in the following descriptions.

Figure 4B:
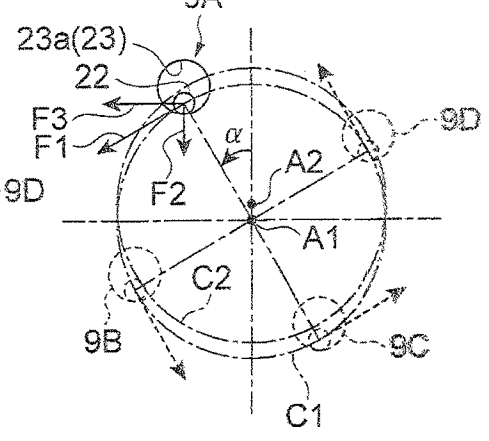

As illustrated in FIG. 4B, the interlocking mechanism 9A counterclockwise revolves by 30°. In this case, a revolution angle $\alpha$ is 30°. In this case, the direction of the pin input F1 also corresponds to the tangent direction of the virtual circle C1. Moreover, magnitude of the pin input F1 is substantially the same as that of the pin input F1 in FIG. 4A. Regardless of the revolution angle $\alpha$ of the interlocking mechanism 9A, the direction of the pin input F1 remains in the tangent direction of the virtual circle C1. Moreover, the magnitude of the pin input F1 remains constant regardless of the revolution angle $\alpha$ of the interlocking mechanism 9A. Meanwhile, in a state in FIG. 4B, a direction of a vertical component of the pin input F1 corresponds to a direction toward the inner circumferential surface 23*a* of the guide ring 23 (refer to F2 in FIG. 4B). Therefore, the guide ring 23 presses the driving pin 22. The vertical component of the pin input F1 will be referred to as action force F2 to a guide ring in the following descriptions.

Figure 4C:
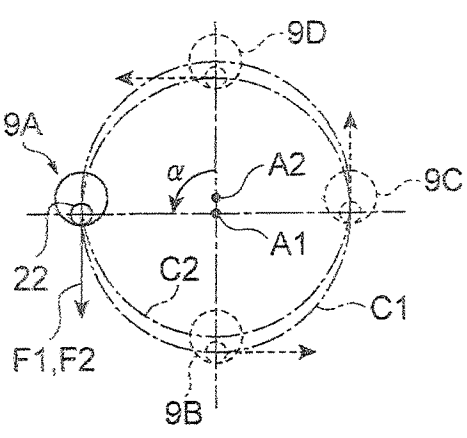

As illustrated in FIG. 4C, the interlocking mechanism 9A further counterclockwise revolves by 60° from the state in FIG. 4B. The interlocking mechanism 9A is at a position where the revolution has been performed by 90° from the initial position. In this case, the revolution angle $\alpha$ is 90°. In a state in FIG. 4C, the tangent direction of the virtual circle C1 corresponds to the vertical direction. Therefore, magnitude of the action force F2 to a guide ring is substantially equal to that of the pin input F1.

Figure 4D:
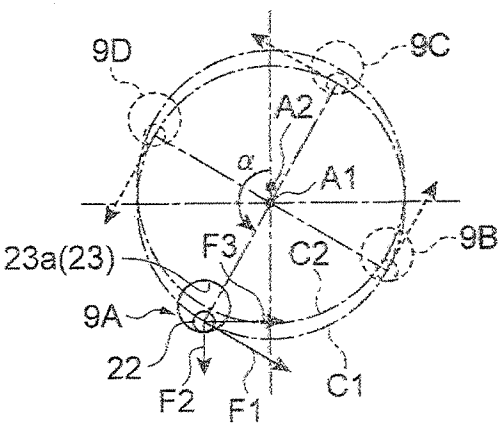

As illustrated in FIG. 4D, the interlocking mechanism 9A further counterclockwise revolves by 60° from the state in FIG. 4C. The interlocking mechanism 9A is at a position where the revolution has been performed by 150° from the initial position. In this case, the revolution angle $\alpha$ is 150°. In a state in FIG. 4D, a direction of the vertical component of the pin input F1 is in a direction toward the inner circumferential surface 23*a* of the guide ring 23. Therefore, the vertical component of the pin input F1 acts on the guide ring 23 as the action force F2 to a guide ring. In this case, the action force F2 to a guide ring is smaller than that in FIG. 4C.

Figure 4E:
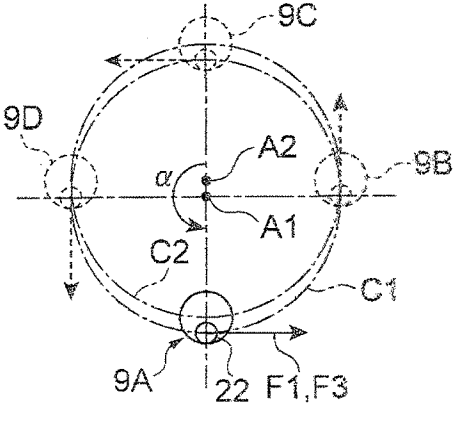

As illustrated in FIG. 4E, the interlocking mechanism 9A further counterclockwise revolves by 30° from the state in FIG. 4D. The interlocking mechanism 9A is at a position where the revolution has been performed by 180° from the initial position. In a state in FIG. 4E, the direction of the pin input F1 corresponds to the horizontal direction. Therefore, magnitude of the vertical component of the pin input F1 is zero. In other words, magnitude of the action force F2 to a guide ring is zero.

Figure 4F:
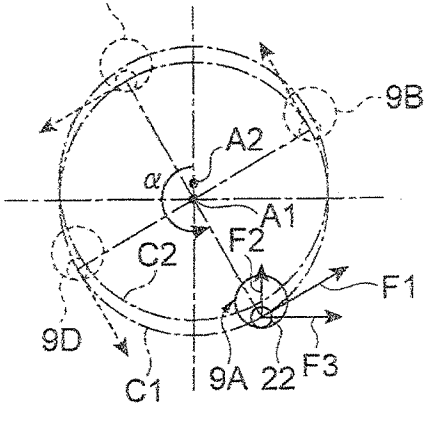

As illustrated in FIG. 4F, the interlocking mechanism 9A further counterclockwise revolves by 30° from the state in FIG. 4E. The interlocking mechanism 9A is at a position where the revolution has been performed by 210° from the initial position. In this case, the revolution angle α is 210°. In a state in FIG. 4F, the direction of the vertical component of the pin input F1 is in a vertically upward direction. Therefore, the guide ring 23 does not press the driving pin 22. The direction of the vertical component of the pin input F1 illustrated in FIG. 4F remains until the interlocking mechanism 9A goes back to the position in FIG. 4A again.

Figure 5A:
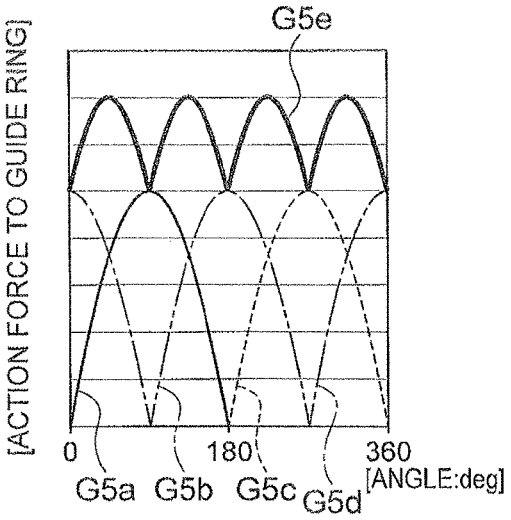
FIG. 5A is a graphical representation of action force to the guide ring.

The above-described pin input F1 will be described with reference to FIGS. 5A, 5B, 5C, and 5D. FIG. 5A is a graphical representation of a relationship between the revolution angle α and the action force F2 to a guide ring. The vertical axis represents magnitude of the action force. The horizontal axis represents the revolution angle α. A graph G5*a* is the action force F2 to a guide ring, of the interlocking mechanism 9A. When the graph G5*a* is carefully observed, in a case where the revolution angle α is 0°, the magnitude of the action force F2 is zero. The magnitude of the action force F2 increases as the revolution angle α becomes close to 90°. When the revolution angle α is 90°, the magnitude of the action force F2 becomes maximal value. After that, when the revolution angle α is between 90° and 180°, the magnitude of the action force F2 decreases. When the revolution angle α is 180°, the magnitude of the action force F2 becomes zero. After that, when the revolution angle α is between 180° and 360°, the magnitude of the action force F2 becomes negative.

A graph G5*b* represents action force F2 to a guide ring, of an interlocking mechanism 9B (refer to FIG. 4A). The interlocking mechanism 9B is disposed on a position separating from the interlocking mechanism 9A by 90°. Therefore, the graph G5*b* of the interlocking mechanism 9B deviates from the graph G5*a* of the interlocking mechanism 9A by 90° in terms of phase. A graph G5*c* represents action force F2 to a guide ring, of an interlocking mechanism 9C (refer to FIG. 4A). The interlocking mechanism 9C is disposed on a position separating from the interlocking mechanism 9A by 180°. Therefore, the graph G5*c* of the interlocking mechanism 9C deviates from the graph G5*a* of the interlocking mechanism 9A by 180° in terms of phase. A graph G5*d* represents action force F2 to a guide ring, of an interlocking mechanism 9D (refer to FIG. 4A). The interlocking mechanism 9D is disposed on a position separating from the interlocking mechanism 9A by 270°. Therefore, the graph G5*d* of the interlocking mechanism 9D deviates from the graph G5*a* of the interlocking mechanism 9A by 270° in terms of phase. Note that, a graph G5*e* represents total action force. The total action force is resultant force that sums the action force F2 of the interlocking mechanism 9A, the action force F2 of the interlocking mechanism 9B, the action force F2 of the interlocking mechanism 9C, and the action force F2 of the interlocking mechanism 9D.

As illustrated in FIG. 5A, in the scroll expander 1 according to the present embodiment, the action force F2 to a guide ring occurs on each of at least two of the interlocking mechanisms 9A, 9B, 9C, and 9D in a direction in which the driving pin 22 presses the guide ring 23 (vertically downward direction) except the revolution angles α of the interlocking mechanism 9A of 0°, 90°, 180°, and 270°. In other words, in the relative orbiting movement of the driven scroll body 7 with respect to the driving scroll body 6, the driving scroll body 6 is supported by at least two sets of the driving pin 22 and the guide ring 23.

The driving pin 22 of the scroll expander 1 revolves around the first axis line A1. The end of the driving pin 22 is disposed inside the guide ring 23. Therefore, the driving pin 22 revolves around the first axis line A1 while pressing the inner circumferential surface 23*a* of the guide ring 23. A direction of the force caused by the revolution constantly corresponds to a tangent direction of a circle around the first axis line A1. When the plate 21 including the guide ring 23 disposed therein rotates, a direction of force acting from the driving pin 22 to the guide ring 23 varies. The force acting on the guide ring 23 sometimes corresponds to the vertical component of the pin input F1. Meanwhile, the direction of the pin input F1 varies depending on a revolution position of the driving pin 22. For example, when the vertical component of the pin input F1 is in the vertically downward direction, the force acts on the guide ring 23. In contrast, when the vertical component of the pin input F1 is in the vertically upward direction, no force acts on the guide ring 23. Here, four sets of the driving pin 22 and the guide ring 23 are disposed at an interval of 90°. As a result, there are at least two sets of the guide ring 23 and the driving pin 22 that generates the action force F2 to a guide ring in the vertically downward direction. In the relative orbiting movement of the driven scroll body 7 with respect to the driving scroll body 6, the driving scroll body 6 is supported by at least two sets of the driving pin 22 and the guide ring 23. According to this configuration, since bearing power of the driving scroll body 6 is smoothly received, a variation of the bearing power upon the orbiting movement is inhibited. Therefore, the scroll expander 1 according to the one embodiment of the present invention can maintain a favorable rotating state.

The scroll expander 1 tolerates revolution movement of the driving pin 22 with the slide of the driving pin 22 with respect to the guide ring 23. The interlocking mechanism 9 including the driving pin 22 and the guide ring 23 includes a dimension error of the respective parts and an assembly error which may occur upon the assembly. These errors cause a slight backlash between a plurality of interlocking mechanisms 9. The driving pin 22 includes a hard film 27. The hard film 27 comes in contact with the inner circumferential surface 23*a* of the guide ring 23 made of resin. According to this configuration, friction between the driving pin 22 and the guide ring 23 abrades the inner circumferential surface of the guide ring 23. Therefore, since the slight backlash between the plurality of interlocking mechanisms 9 is eliminated, the relative orbiting movement of the driven scroll body 7 with respect to the driving scroll body 6 can be smoother.

Figure 5B:
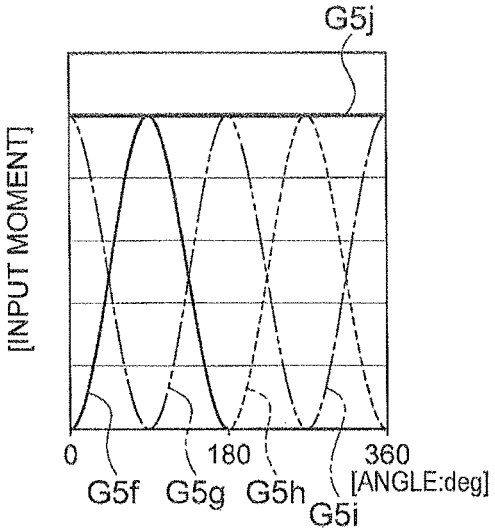
FIG. 5B is a graphical representation of an input moment.

FIG. 5B is a graphical representation of a relationship between the revolution angle α and an input moment. The input moment is based on a distance from the first axis line A1 to a position where action force F2 to a guide ring is input (action distance), and magnitude of the action force F2 to a guide ring. In other words, the action distance is a distance between the center of the driving end plate 16 including the driving pin 22 disposed therein and the position where the action force F2 to a guide ring is input. The driving pin 22 is disposed on the virtual circle C1. Meanwhile, the guide ring 23 is disposed on a virtual circle C2 around the second axis line A2. With this arrangement, the input moment periodically varies. A graph G5*f* represents an input moment of the interlocking mechanism 9A. A graph G5*g* represents an input moment of the interlocking mechanism 9B. A graph G5*h* represents an input moment of the interlocking mechanism 9C. A graph G5*i* represents an input moment of the interlocking mechanism 9D. A graph G5*j* represents a total input moment. The total input moment is a total moment that sums the input moment of the interlocking mechanism 9A, the input moment of the interlocking mechanism 9B, the input moment of the interlocking mechanism 9C, and the input moment of the interlocking mechanism 9D. The number of the driving pins 22 and the number of the guide rings 23 are an even number. Therefore, the number of the interlocking mechanisms 9 in a region where the action force F2 to a guide ring is in the vertically downward direction (revolution angle α of 0° or more and 180° or less) is constant (two). With this arrangement, as the graph G5*j* is illustrated, the periodical variation of the input moment caused by a periodical variation of the action distance is inhibited. Therefore, the total input moment remains constant.

More specifically, the action distance periodically varies while the interlocking mechanisms 9A, 9B, 9C, and 9D revolve by 360°. A positional relationship and a force relationship between the driving scroll body 6 and the driven scroll body 7 apparently vary depending on a selected standard. For example, FIGS. 4A, 4B, 4C, 4D, 4E, and 4F are diagrams with, as a standard for rotary movement, the center of the driving end plate 16 including the driving pin 22 disposed therein (namely, the first axis line A1). Similarly, for example, FIGS. 5A, 5B, 5C, and 5D are also diagrams with the center of the driving end plate 16 as the standard for rotary movement. Meanwhile, when the center of the plate 21 including the guide ring 23 disposed therein (namely, the second axis line A2) is defined as the standard for rotary movement, a result different from that in FIG. 4A is observed.

Figure 5C:
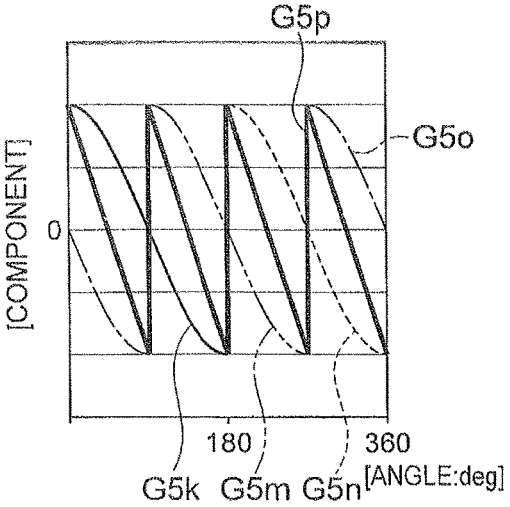
FIG. 5C is a graphical representation of a component.

As illustrated in, for example, FIG. 4B, the pin input F1 is resolved into the action force F2 to a guide ring as the vertical component and a component F3 as the horizontal component. FIG. 5C is a graphical representation of a relationship between the revolution angle α and a component F3. A graph G5*k* represents the component F3 of the interlocking mechanism 9A. A graph G5*m* represents a component F3 of the interlocking mechanism 9B. A graph G5*n* represents a component F3 of the interlocking mechanism 9C. A graph G5*o* represents a component F3 of the interlocking mechanism 9D. Phase differences of the graphs G5*k*, G5*m*, G5*n*, and G5*o* correspond to arrangement angles of the interlocking mechanisms 9A, 9B, 9C, and 9D, respectively. A graph G5*p* represents a total component. The total component sums the component F3 of the interlocking mechanism 9A, the component F3 of the interlocking mechanism 9B, the component F3 of the interlocking mechanism 9C, and the component F3 of the interlocking mechanism 9D. For example, as the graph G5*k* is illustrated, the revolution angle α is zero (α=0°), the component F3 corresponds to the pin input F1 in terms of magnitude. When the revolution angle α is 90° (α=90°), the magnitude of the component F3 is zero. When the revolution angle α is 180° (α=180°), the component F3 corresponds to the pin input F1 in terms of magnitude. In this case, a direction of the component F3 is opposite to that in the case where the revolution angle α is zero (α=0°).

Here, it is assumed a condition in which there is no gap between the driving wrap 17 and the driven wrap 19 (namely, leakage-zero). Under this assumption, when the driven scroll body 7 relatively orbits with respect to the driving scroll body 6, the component F3 is the horizontal component. Therefore, since there is no vertical component, the component F3 can be omitted. However, the condition in which there is no gap between the driving wrap 17 and the driven wrap 19 is an ideal condition. There is a gap between the driving wrap 17 and the driven wrap 19 in a state close to an actual environment. In this case, a direction of the component F3 is not horizontal. Since the component F3 includes a vertical component, the component F3 cannot be omitted.

Figure 5D:
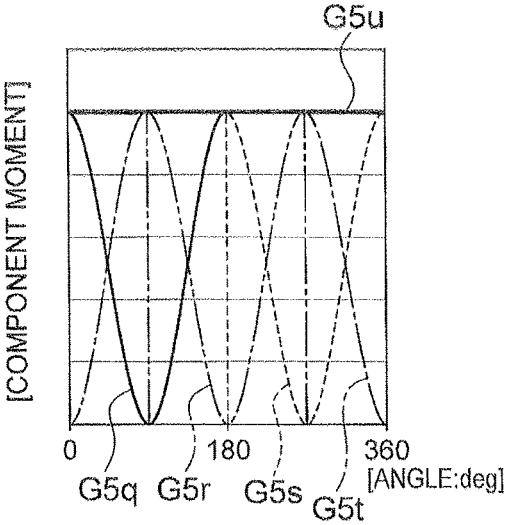
FIG. 5D is a graphical representation of a component moment.

FIG. 5D is a graphical representation of a relationship between the revolution angle α and a component moment. The component moment is based on a distance from the first axis line A1 to a position where the component F3 is input, and the magnitude of the component F3. A graph G5*q* represents a component moment of the interlocking mechanism 9A. A graph G5*r* represents a component moment of the interlocking mechanism 9B. A graph G5*s* represents a component moment of the interlocking mechanism 9C. A graph G5*t* represents a component moment of the interlocking mechanism 9D. Phase differences of the graphs G5*q*, G5*r*, G5*s*, and G5*t* correspond to the arrangement angles of the interlocking mechanisms 9A, 9B, 9C, and 9D, respectively. A graph G5*u* represents a total component moment. The total component moment is a total moment that sums the component moment of the interlocking mechanism 9A, the component moment of the interlocking mechanism 9B, the component moment of the interlocking mechanism 9C, and the component moment of the interlocking mechanism 9D. As the graph G5*u* is illustrated, the total component moment remains constant regardless of the revolution angle α, like the input moment (refer to the graph G5*j* in FIG. 5B). Therefore, even under the condition where the component F3 cannot be omitted, the scroll expander 1 including four interlocking mechanisms 9A, 9B, 9C, and 9D (even number) inhibits the variation of the total component moment. Therefore, the scroll expander 1 can maintain a favorable rotating state.

Here, operation of a scroll expander according to a comparative example will be illustrated and an effect of the scroll expander 1 according to the present embodiment will be further described. The scroll expander according to the comparative example is different from the scroll expander 1 according to the present embodiment in that three interlocking mechanisms are provided. The interlocking mechanisms of the scroll expander according to the comparative example are disposed at an interval of 120° along a direction of the circumference of a circle around a first axis line A1. A configuration of the single interlocking mechanism and other configurations in the scroll expander according to the comparative example and are substantially the same as those in the scroll expander 1 according to the present embodiment. Differences in operation between the scroll expander 1 including four interlocking mechanisms 9 and the scroll expander including three interlocking mechanisms will be carefully observed and described below.

Figure 8A:
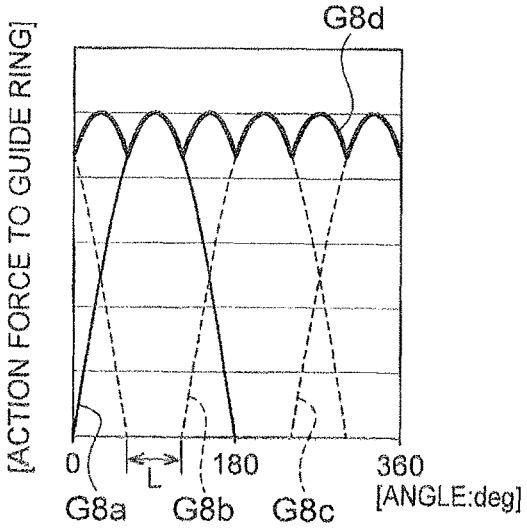
FIG. 8A is a graphical representation of action force to a guide ring of a scroll expander according to a comparative example.

FIG. 8A is a graphical representation of a relationship between a revolution angle α and action force F2 to a guide ring in the scroll expander according to the comparative example. A graph G8*a* represents action force F2 to a guide ring, of a first interlocking mechanism. A graph G8*b* represents action force F2 to a guide ring, of a second interlocking mechanism. A graph G8*c* represents action force F2 to a guide ring, of a third interlocking mechanism. Moreover, a graph G8*d* represents total action force. An angle region L where the revolution angle α is 60° or more and 120° or less is carefully observed. In the angle region L, the action force F2 to a guide ring occurs on only the first interlocking mechanism corresponding to the graph G8*a* in the vertically downward direction.

That is, the scroll expander including three interlocking mechanisms 9 has a period during which the driving scroll body 6 is supported by a set of the driving pin 22 and the guide ring 23 (angle region L). Meanwhile, the scroll expander 1 including four interlocking mechanisms 9 is supported by at least two interlocking mechanisms 9. That is, in the scroll expander 1 including four interlocking mechanisms 9, at least two sets of the driving pin 22 and the guide ring 23 generate bearing power. Therefore, since the bearing power of the driving scroll body 6 is smoothly received, the scroll expander 1 can maintain a favorable rotating state. Moreover, when the total action force according to the comparative example (graph G8*d* in FIG. 8A) and the total action force according to the present embodiment (graph G5*e* in FIG. 5A) are compared, the total action force according to the present embodiment is totally larger than that according to the comparative example. Therefore, the configuration according to the present embodiment is smaller than that according to the comparative example in terms of a load one interlocking mechanism 9 receives. The scroll expander 1 according to the present embodiment can improve flexibility of design for the interlocking mechanism 9.

Figure 8B:
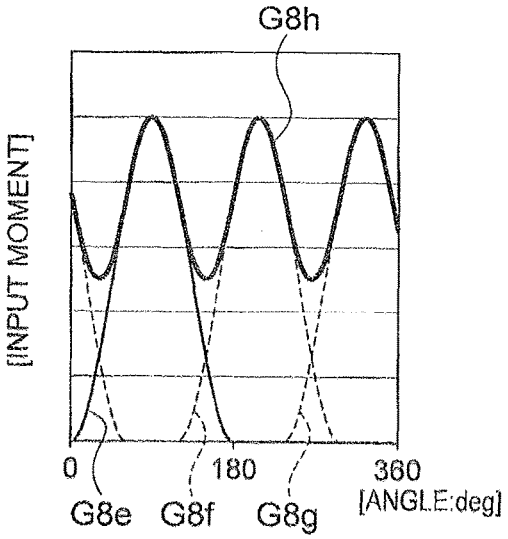
FIG. 8B is a graphical representation of an input moment of the scroll expander according to the comparative example.

FIG. 8B is a graphical representation of a relationship between the revolution angle α and an input moment of the scroll expander according to the comparative example. A graph G8*e* represents an input moment of the first interlocking mechanism. A graph G8*f* represents an input moment of the second interlocking mechanism. A graph G8*g* represents an input moment of the third interlocking mechanism. A graph G8*h* represents a total input moment. The total input moment (graph G8*h*) is carefully observed. The total input moment according to the comparative example varies depending on the revolution angle α. Meanwhile, the total input moment according to the present embodiment (graph G5*j* in FIG. 5B) remains constant regardless of the revolution angle α. Therefore, since the variation of the total input moment due to the revolution angle α is inhibited, the scroll expander 1 according to present embodiment can maintain a favorable rotating state.

Figure 8C:
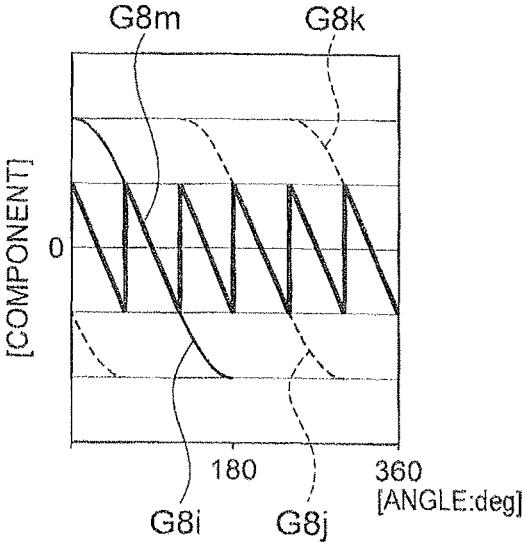
FIG. 8C is a graphical representation of a component of the scroll expander according to the comparative example.
Figure 8D:
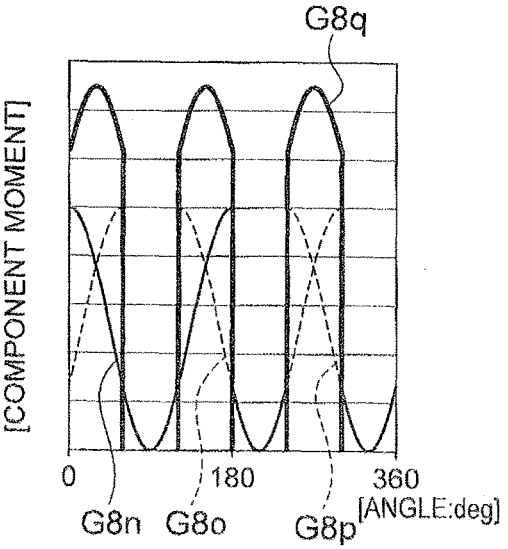
FIG. 8D is a graphical representation of a component moment of the scroll expander according to the comparative example.

FIG. 8C is a graphical representation of a relationship between the revolution angle α and a component F3 of the scroll expander according to the comparative example. A graph G8*i* represents a component F3 of the first interlocking mechanism. A graph G8*j* represents a component F3 of the second interlocking mechanism. A graph G8*k* represents a component F3 of the third interlocking mechanism. A graph G8*m* represents a total component. FIG. 8D is a graphical representation of a relationship between the revolution angle α and a component moment of the scroll expander according to the comparative example. A graph G8*n* represents a component moment of the first interlocking mechanism. A graph G8*o* represents a component moment of the second interlocking mechanism. A graph G8*p* represents a component moment of the third interlocking mechanism. A graph G8*q* represents a total component moment. The total component moment (graph G8*q* in FIG. 8D) is carefully observed. The total component moment according to the comparative example varies depending on the revolution angle α. This can be thought that since the scroll expander according to the comparative example includes three interlocking mechanisms 9, the number of the driving pin 22 that presses the guide ring 23 changes into, for example, one and then two during one revolution. Meanwhile, the total component moment according to the present embodiment (graph G5*u* in FIG. 5D) remains constant regardless of the revolution angle α. Therefore, since the variation of the total component moment due to the revolution angle α is inhibited, the scroll expander 1 according to the present embodiment can maintain a favorable rotating state.

The embodiment of the present invention has been described above. However, the present invention is not limited to the above-described embodiment. The present invention may include a modification without changing the spirit described in the claims.

(First Modification)

Figure 6A:
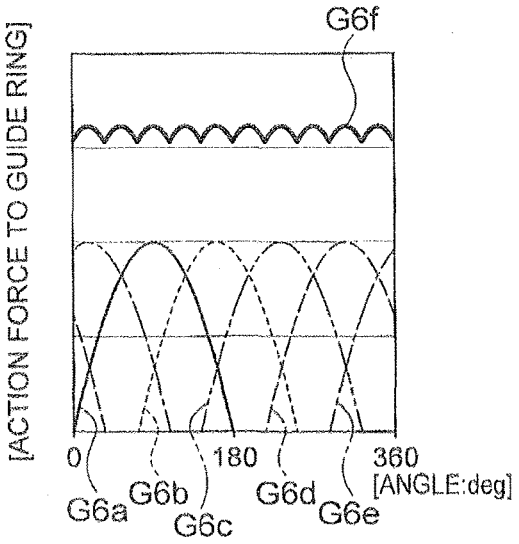
FIG. 6A is a graphical representation of action force to a guide ring in a scroll expander according to a first modification.

For example, the scroll expander may include five interlocking mechanisms 9 each including the driving pin 22 and the guide ring 23. In this case, the interlocking mechanisms 9 are disposed at an interval of 72° around the first axis line A1. FIG. 6A is a graphical representation of a relationship between a revolution angle α and action force F2 to a guide ring in the scroll expander including the five interlocking mechanisms 9 (hereinafter, also referred to as a scroll expander according to a first modification). Graphs G6*a*, G6*b*, G6*c*, G6*d*, and G6*e* each correspond to each of the five interlocking mechanisms 9. A graph G6*f* represents total action force. When the action force F2 to a guide ring, of each of the interlocking mechanisms 9 (graphs G6*a*, G6*b*, G6*c*, G6*d*, and G6*e*) is carefully observed, it can be seen that at least two interlocking mechanisms 9 generate bearing power at the revolution angle α between 0° and 360°. For example, when the revolution angle α is 90°, three interlocking mechanisms 9 including the interlocking mechanism 9 corresponding to the graph G6*a*, the interlocking mechanism 9 corresponding to the graph G6*b*, and the interlocking mechanism 9 corresponding to the graph G6*e*, individually generate bearing power. Therefore, at any revolution angle α, two or three interlocking mechanisms 9 individually generate bearing power. In other words, there is no case where there is only one interlocking mechanism 9 to be involved in the support. Therefore, the scroll expander according to the first modification can maintain a favorable rotating state. Moreover, when carefully observed, the total action force (graph G6*f* in FIG. 6A) totally becomes larger than the total action force according to the above-described embodiment (graph G5*e* in FIG. 5A). Therefore, a load one interlocking mechanism 9 receives can be further reduced.

Figure 6B:
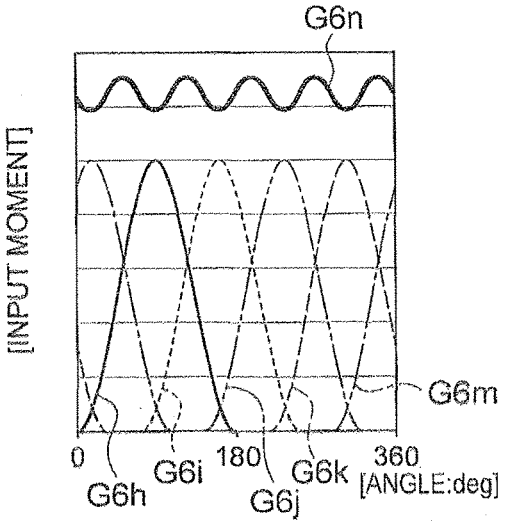
FIG. 6B is a graphical representation of an input moment of the scroll expander according to the first modification.
Figure 6C:
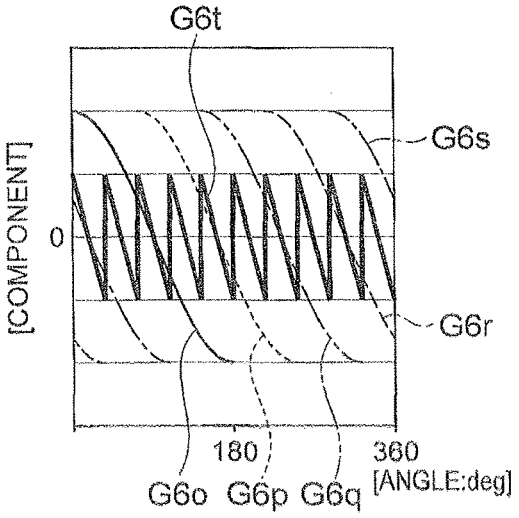
FIG. 6C is a graphical representation of a component of the scroll expander according to the first modification.
Figure 6D:
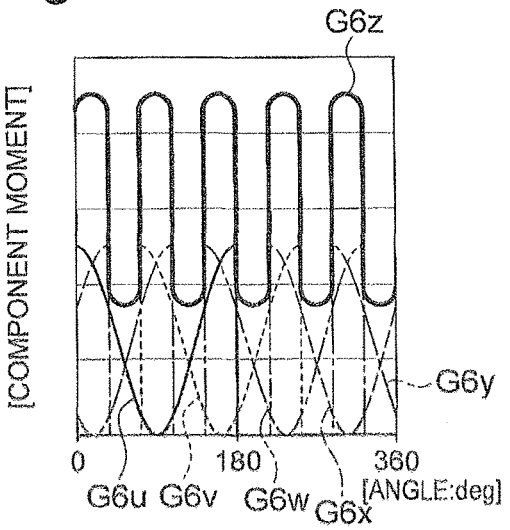
FIG. 6D is a graphical representation of a component moment of the scroll expander according to the first modification.

FIG. 6B is a graphical representation of a relationship between the revolution angle α and an input moment of the scroll expander according to the first modification. FIG. 6C is a graphical representation of a relationship between the revolution angle α and a component F3 of the scroll expander according to the first modification. FIG. 6D is a graphical representation of a relationship between the revolution angle α and a component moment of the scroll expander according to the first modification. In each of the graphical representations, graphs G6*h*, G6*i*, G6*j*, G6*k*, and G6*m*, graphs G6*o*, G6*p*, G6*q*, G6*r*, and G6*s*, and graphs G6*u*, G6*v*, G6*w*, G6*x*, and G6*y* each correspond to the five interlocking mechanisms 9. A graph G6*n* in FIG. 6B represents a total input moment. A graph G6*t* in FIG. 6C represents a total component. A graph G6*z* in FIG. 6D represents a total component moment. When the total input moment (graph G6*n* in FIG. 6B) and the total component moment (graph G6*z* in FIG. 6D) are carefully observed, the total input moment and the total component moment periodically vary depending on the revolution angle α.

(Second Modification)

Figure 7A:
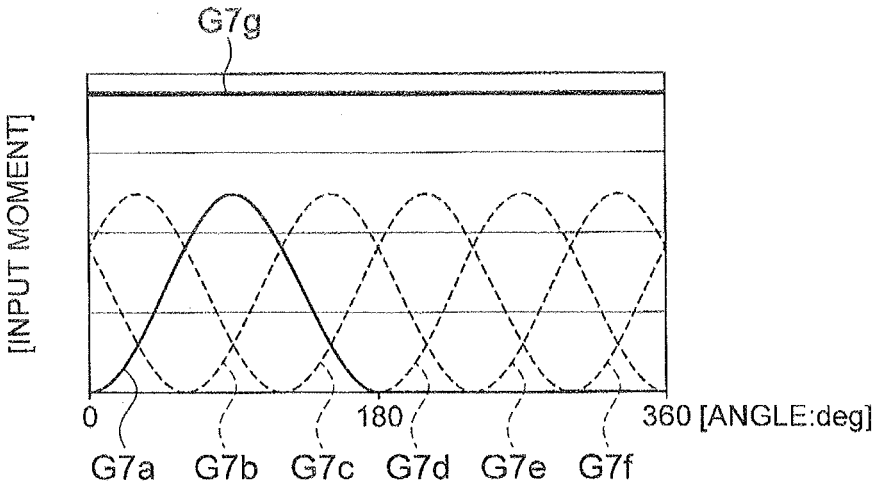
FIG. 7A is a graphical representation of an input moment of a scroll expander according to a second modification.
Figure 7B:
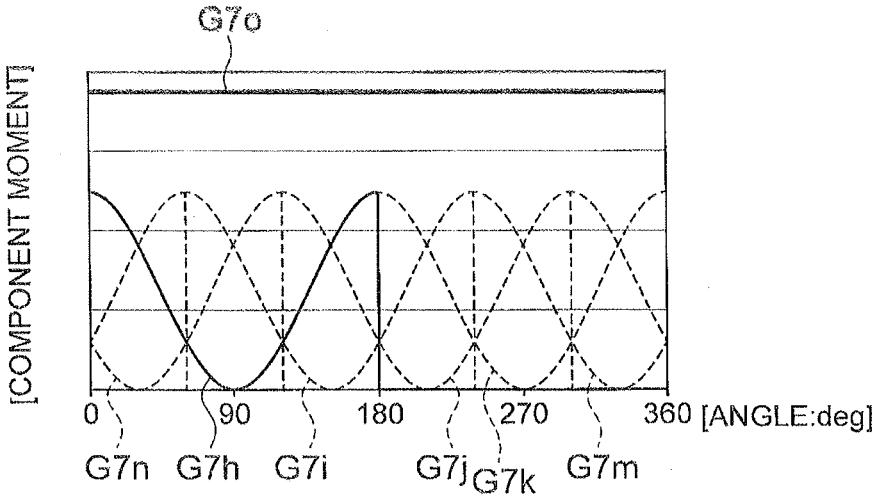
FIG. 7B is a graphical representation of a component moment of the scroll expander according to the second modification.

For example, a scroll expander may include six interlocking mechanisms 9 each including a driving pin 22 and the guide ring 23. In this case, the interlocking mechanisms 9 are disposed at an interval of 60° around the first axis line A1. FIG. 7A is a graphical representation of a relationship between a revolution angle α and an input moment of the scroll expander including the six interlocking mechanisms 9 (hereinafter, also referred to as a scroll expander according to a second modification). FIG. 7B is a graphical representation of a relationship between the revolution angle α and a component moment of the scroll expander according to the second modification. Graphs G7*a*, G7*b*, G7*c*, G7*d*, G7*e*, and G7*f* each correspond to the six interlocking mechanisms 9. Graphs G7*h*, G7*i*, G7*j*, G7*k*, G7*m*, and G7*n* each correspond to the six interlocking mechanisms 9. A graph G7*g* in FIG. 7A represents a total input moment. A graph G7*o* in FIG. 7B represents a total component moment. When the total input moment (graph G7*g* in FIG. 7A) and the total component moment (graph G7*o* in FIG. 7B) are carefully observed, magnitude of the total input moment and magnitude of the total component moment remain constant regardless of the revolution angle α. Like the scroll expander according to the first modification, in the scroll expander according to the second modification, at least two interlocking mechanisms 9 each generate bearing power at the revolution angle α between 0° and 360°. Therefore, at any revolution angle α, two or three interlocking mechanisms 9 are involved in the support. In other words, there is no case where there is instantaneously only one interlocking mechanism 9 to be involved in the support. Therefore, the scroll expander according to the second modification can maintain a more favorable rotating state.

(Third Modification)

For example, in the above-described embodiment, the scroll expander has been exemplified as a specific example of a scroll fluid machine. The scroll fluid machine according to one embodiment of the present invention is not limited to the scroll expander. For example, the scroll fluid machine may include a scroll compressor or a scroll vacuum pump.

What is claimed is:

1. A scroll fluid machine comprising:

a driving scroll body that includes a pair of driving end plates and a driving wrap formed on each of the pair of driving end plates, and has a first axis line as a rotary shaft line;

a driven scroll body that includes a driven end plate and a driven wrap formed on each of both surfaces of the driven end plate, is disposed between the pair of driving end plates, and has, as a rotary shaft line, a second axis line shifted with respect to the first axis line;

a bearing plate that is disposed on each of both sides of the driven scroll body, includes a pair of plates coupled to the driven scroll body, and has the second axis line as a rotary shaft line;

an interlocking mechanism causes the driven scroll body to revolve relative to the driving scroll body, wherein the interlocking mechanism including a cylindrical driving pin that is attached to the driving scroll body and protrudes from the driving end plate to the bearing plate; and a cylindrical guide ring is attached to the bearing plate, wherein the cylindrical guide ring includes a ring portion having a guide hole, a flange portion being formed on one side of the ring portion and fixed to the bearing plate, an inner diameter of the guide hole larger than an outer diameter of the cylindrical driving pin and the cylindrical driving pin disposed in the guide hole, wherein n driving pins (n≥4) are disposed on a circumference of a circle around the first axis line at an equal interval, and m guide rings (m=n≥4) are disposed on a circumference of a circle around the second axis line at the equal interval so as to correspond to the driving pins.

2. The scroll fluid machine according to claim 1, wherein the number of the driving pins (n) and the number of the guide rings (m) are an even number.

* * * * *